US011773527B2

(12) United States Patent
Bronn et al.

(10) Patent No.: US 11,773,527 B2
(45) **Date of Patent: *Oct. 3, 2023**

(54) LAUNDRY TREATING APPLIANCE AND DISPENSER

(71) Applicant: WHIRLPOOL CORPORATION, Benton Harbor, MI (US)

(72) Inventors: Tobias Bronn, Althutte (DE); Tibor Budicky, Poprad (SK); Jan Martinko, Poprad (SK)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/536,201

(22) Filed: Nov. 29, 2021

(65) Prior Publication Data

US 2022/0081822 A1 Mar. 17, 2022

Related U.S. Application Data

(60) Continuation of application No. 16/850,386, filed on Apr. 16, 2020, now Pat. No. 11,214,911, which is a (Continued)

(51) Int. Cl.
*D06F 39/02* (2006.01)

(52) U.S. Cl.
CPC ..... *D06F 39/02* (2013.01); *D06F 39/022* (2013.01); *D06F 39/028* (2013.01)

(58) Field of Classification Search
CPC ..... D06F 39/02; D06F 39/022; D06F 39/024; D06F 39/026; D06F 39/028
See application file for complete search history.

(56) References Cited

U.S. PATENT DOCUMENTS 6,826,933 B2 12/2004 Merkle et al.
7,481,082 B2 1/2009 Cho et al.
(Continued)

FOREIGN PATENT DOCUMENTS

CN 1715521 A 1/2006
CN 1715522 A 1/2006
(Continued)

OTHER PUBLICATIONS

European Search Report for Counterpart EP17200349.3, dated Mar. 8, 2018.

*Primary Examiner* — Spencer E. Bell
*Assistant Examiner* — Omair Chaudhri
(74) *Attorney, Agent, or Firm* — McGarry Bair PC

(57) ABSTRACT

A dispenser for a laundry treating appliance comprising at least one treating chemistry compartment having a chamber and defining an outlet opening fluidly coupling the chamber to an exterior of the chamber; the at least one chemistry compartment comprising edges, a siphon comprising grooves that receive the edges of the treating chemistry compartment to slideably connect the siphon to the treating chemistry compartment for selectively opening or closing the outlet opening, and an actuator moving the siphon between a first position, wherein the siphon closes the outlet opening to enable the dispenser to operate in a liquid mode, and a second position, wherein the siphon opens at least a portion of the outlet opening to enable the dispenser to operate in a powder mode.

20 Claims, 8 Drawing Sheets

Related U.S. Application Data division of application No. 15/354,077, filed on Nov. 17, 2016, now Pat. No. 10,648,121.

(56) References Cited

U.S. PATENT DOCUMENTS

| | | | | |
|---|---|---|---|---|
| 8,943,859 | B2 | 2/2015 | Sung et al. | |
| 2005/0274155 | A1* | 12/2005 | Namkung | D06F 39/02 68/17 R |
| 2005/0274157 | A1 | 12/2005 | Yang | |
| 2007/0044517 | A1 | 3/2007 | Yang et al. | |
| 2007/0131000 | A1 | 6/2007 | Jeong | |
| 2012/0017653 | A1* | 1/2012 | Doh | D06F 39/022 68/17 R |
| 2012/0204606 | A1* | 8/2012 | Buso | D06F 39/02 68/17 R |
| 2017/0159227 | A1* | 6/2017 | Jung | D06F 39/022 |

FOREIGN PATENT DOCUMENTS

| | | | | |
|---|---|---|---|---|
| CN | 104711821 | A * | 6/2015 | D06F 33/02 |
| DE | 3712323 | A1 | 10/1988 | |
| DE | 19807595 | A1 | 8/1999 | |
| EP | 1485530 | B1 | 7/2006 | |
| EP | 1808520 | A1 | 7/2007 | |
| EP | 2048275 | A1 | 4/2009 | |
| EP | 2133456 | A1 | 12/2009 | |
| EP | 2365120 | A1 | 9/2011 | |
| EP | 2377987 | A1 | 10/2011 | |
| EP | 2423373 | A1 | 2/2012 | |
| EP | 2604743 | A2 | 6/2013 | |
| EP | 2519679 | B1 | 4/2014 | |
| EP | 2655721 | B1 | 11/2014 | |
| EP | 2655722 | B1 | 6/2015 | |
| EP | 2889419 | A1 * | 7/2015 | D06F 39/02 |
| EP | 2604743 | B1 * | 8/2015 | D06F 39/02 |
| GB | 2187764 | A * | 9/1987 | D06F 39/02 |
| GB | 2187764 | A | 9/1987 | |
| GB | 2386613 | A | 9/2003 | |
| IT | 1230514 | B | 10/1991 | |
| KR | 20030061181 | A | 7/2003 | |
| KR | 20050069793 | A * | 7/2005 | |
| KR | 20090099809 | A | 9/2009 | |
| RU | 2468132 | C2 | 11/2012 | |
| WO | 2011023808 | A1 | 3/2011 | |
| WO | 2012085827 | A2 | 6/2012 | |

* cited by examiner

LAUNDRY TREATING APPLIANCE AND DISPENSER

CROSS-REFERENCE TO RELATED APPLICATIONS

The present application is a continuation application of U.S. patent application Ser. No. 16/850,386, filed Apr. 16, 2020, now U.S. Pat. No. 11,214,911, issued Jan. 4, 2022, which is a divisional application of U.S. patent application Ser. No. 15/354,077, filed Nov. 17, 2016, now U.S. Pat. No. 10,648,121, issued May 12, 2020, both of which are hereby incorporated by reference herein in their entirety.

BACKGROUND

Laundry treating appliances, such as clothes washers, clothes dryers, refreshers, and non-aqueous systems, can have a configuration based on a rotating drum that defines a treating chamber having an access opening through which laundry items are placed in the treating chamber for treating. The laundry treating appliance can have a controller that implements a number of pre-programmed cycles of operation having one or more operating parameters.

In some laundry treating appliances, the dispenser is in the form of a drawer that slides in/out of the appliance. Such dispensers typically have one or more compartments or cups in which single doses of treating chemistry can be received when the drawer is open. The compartments are typically designed for either a powder or liquid treating chemistry. The powder compartment typically has a relatively large opening through which the powder is flushed out with water to form the treating liquid. The liquid compartment typically has a siphon. When water is added to the liquid compartment, it forms the treating liquid, which is then siphoned out of the compartment. While it is possible to use a siphon with a powder, it is not preferred as the powder does not always dissolve in the water prior to being drawn into the siphon. The non-dissolved particles of treating chemistry in the siphon can negatively impact the performance of the siphon.

BRIEF SUMMARY

One aspect of the disclosure is a dispenser for a laundry treating appliance comprising at least one treating chemistry compartment having a chamber and defining an outlet opening fluidly coupling the chamber to an exterior of the chamber; the at least one chemistry compartment comprising edges, a siphon comprising grooves that receive the edges of the treating chemistry compartment to slideably connect the siphon to the treating chemistry compartment for selectively opening or closing the outlet opening, and an actuator moving the siphon between a first position, wherein the siphon closes the outlet opening to enable the dispenser to operate in a liquid mode, and a second position, wherein the siphon opens at least a portion of the outlet opening to enable the dispenser to operate in a powder mode.

Another aspect of the disclosure is a laundry treating appliance comprising a cabinet defining an interior and having an access opening located on one of a front or top of the cabinet, a tub located within the interior and defining a liquid reservoir, a drum located within the liquid reservoir and rotatable about one of a horizontal or vertical axis, and a dispenser. The dispenser comprises at least one treating chemistry compartment having a chamber and defining an outlet opening fluidly coupling the chamber to an exterior of the chamber; the at least one chemistry compartment comprising edges; a siphon comprising grooves that receive the edges of the treating chemistry compartment to slideably connect the siphon to the treating chemistry compartment for selectively opening or closing the outlet opening; and an actuator moving the siphon between a first position, wherein the siphon closes the outlet opening to enable the dispenser to operate in a liquid mode, and a second position, wherein the siphon opens at least a portion of the outlet opening to enable the dispenser to operate in a powder mode.

Another aspect of the disclosure is a method of selecting between liquid dispensing and powder dispensing in a laundry treating appliance having at least one dispensing chamber for holding a treating chemistry, the method comprising sliding a siphon relative to the dispensing chamber between a first position, where the siphon draws liquid from the chamber, and a second position, where the siphon opens an outlet in the chamber, and wherein moving an actuator moves the siphon between the first position and the second position.

DETAILED DESCRIPTION

Figure 1:
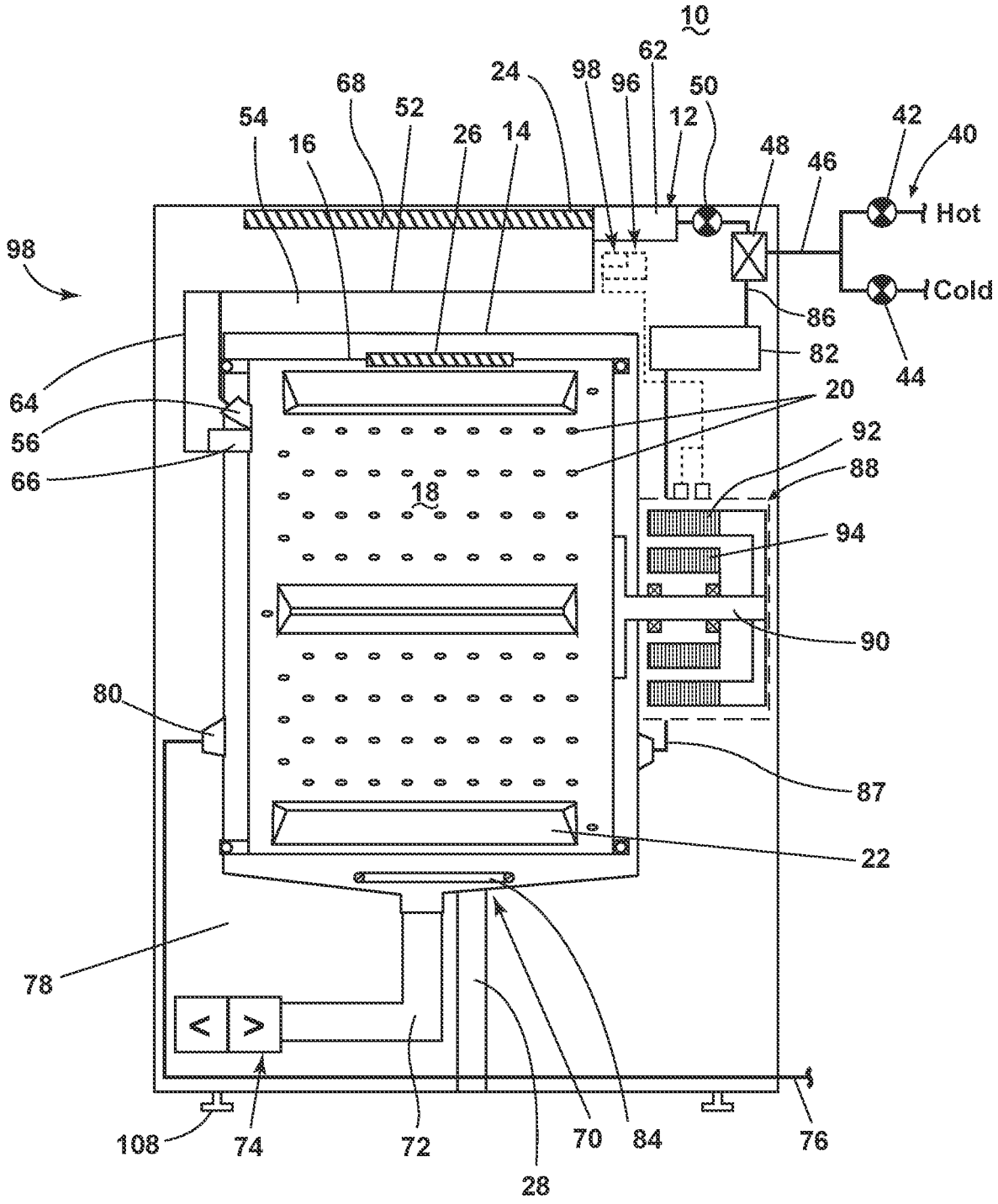
FIG. 1 is a schematic view of a laundry treating appliance in the form of a top-loading horizontal washing machine.

Embodiments of the present disclosure can be utilized with a laundry treating appliance, which can be either as a front or top loading and either a horizontal or vertical axis. For purposes of convenience, not limitation, the embodiments of the disclosure are illustrated in the form of a top-loading, horizontal-axis washing machine 10 as illustrated in FIG. 1.

As used herein, the "horizontal axis" washing machine refers to a washing machine having a rotatable drum, perforated or imperforate, that holds laundry items and washes the laundry items by the laundry items rubbing against one another as the drum rotates. In some horizontal axis washing machines, the drum rotates about a horizontal axis generally parallel to a surface that supports the washing machine. However, the rotational axis need not be horizontal. The drum can rotate about an axis inclined or declined relative to the horizontal axis. In horizontal axis washing machines, the laundry items are lifted by the rotating drum and then fall in response to gravity to form a tumbling action. Mechanical energy is imparted to the laundry items by the tumbling action formed by the repeated lifting and dropping of the laundry items.

For purposes of this description, the terms horizontal axis and vertical axis are used to represent the general orientation of the axis of rotation and is not meant to be limited to a perfectly horizontal or vertical axis of rotation. More accurately, the terms horizontal axis of rotation or vertical axis of rotation, when used to identify the type of laundry treating appliance, are more accurately used to describe the primary mechanism by which mechanical energy is imparted to the laundry. The horizontal axis washing machine imparts mechanical energy primarily by tumbling the laundry within the drum. That is, rotation of the drum lifts and then drops the laundry. This lifting/dropping imparts mechanical energy to the laundry. The vertical axis washing machine imparts mechanical energy via a clothes mover, such as an agitator, impeller, pulsator, auger, etc., which is rotated within the basket to effect movement of liquid in the basket or directly impact the laundry. While a laundry container is normally referred to as a drum for a horizontal axis machine and a basket for a vertical axis machine, for this disclosure, unless otherwise stated, drum and basket are interchangeable.

Regardless of the axis of rotation, a washing machine can be top-loading or front-loading. In a top-loading washing machine, laundry items are placed into the drum through an access opening in the top of a cabinet, while in a front-loading washing machine laundry items are placed into the drum through an access opening in the front of a cabinet. If a washing machine is a top-loading horizontal access washing machine, an additional access opening can be located on the drum.

The laundry treating appliance of FIG. 1 is illustrated as a top-loading, horizontal-axis washing machine 10, which may include a structural support system comprising a cabinet 12 which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system comprises a tub 14 supported within the cabinet 12 by a suitable suspension system 28 and a drum 16 provided within the tub 14, the drum 16 defining at least a portion of a laundry treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It is also within the scope of the invention for the laundry holding system to comprise only a tub with the tub defining the laundry treating chamber.

The laundry holding system may further include a door 24 which may be movably mounted to the cabinet 12 to selectively close both the tub 14 and the drum 16. An additional door 26 may be disposed on the tub 14, with the additional door 26 defining an access opening to the tub 14.

The washing machine 10 can further include a liquid supply system for supplying water to the washing machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 by controlling first and second diverter mechanisms 48 and 50, respectively. The diverter mechanisms 48, 50 can be a diverter valve having two outlets such that the diverter mechanisms 48, 50 and can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14. In this manner, water from the household water supply 40 can be supplied directly to the tub 14.

The washing machine 10 can also be provided with a dispensing system for dispensing treating chemistry to the treating chamber 18 for use in treating the laundry according to a cycle of operation. The dispensing system can include a dispenser 62 which is illustrated as a generic dispenser, which can be a single use dispenser, a bulk dispenser or a combination of a single use and bulk dispenser.

Regardless of the type of dispenser used, the dispenser 62 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the dispenser 62 from the supply conduit 52 by directing the second diverter mechanism 50 to direct the flow of water to a dispensing supply conduit 68.

Non-limiting examples of treating chemistries that can be dispensed by the dispensing system during a cycle of operation include one or more of the following: water, detergents, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

The washing machine 10 can also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the washing machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the laundry within.

The liquid supply and/or recirculation and drain system can be provided with a heating system which can include one or more devices for heating laundry and/or liquid supplied to the tub 14, such as a steam generator 82 and/or a sump heater 84. Liquid from the household water supply 40 controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation.

Additionally, the liquid supply and recirculation and drain system can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system can include a motor 88 for rotationally driving the drum 16. The motor 88 can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled with the drum 16 through a belt and a drive shaft 90 to rotate the drum 16, as is known in the art. Other motors, such as an induction motor or a permanent split capacitor (PSC) motor, can also be used. The motor 88 can rotationally drive the drum 16 including that the motor 88 can rotate the drum 16 at various speeds in either rotational direction. The motor 88 can be configured to rotatably drive the drum 16 in response to a motor control signal.

The washing machine 10 also includes a control system for controlling the operation of the washing machine 10 to implement one or more cycles of operation. The control system can include a controller 96 located within the cabinet 12 and a user interface 98 that is operably coupled with the controller 96. The user interface 98 can include one or more knobs, dials, switches, displays, touch screens, and the like for communicating with the user, such as to receive input and provide output. The user can enter different types of information including, without limitation, laundry treating chemistry concentration and cycle selection and cycle parameters, such as cycle options.

The controller 96 can include the machine controller and any additional controllers provided for controlling any of the components of the washing machine 10. For example, the controller 96 can include the machine controller and a motor controller. Many known types of controllers can be used for the controller 96. It is contemplated that the controller can be a microprocessor-based controller that implements control software and sends/receives one or more electrical signals to/from each of the various working components to effect the control software.

Figure 2:
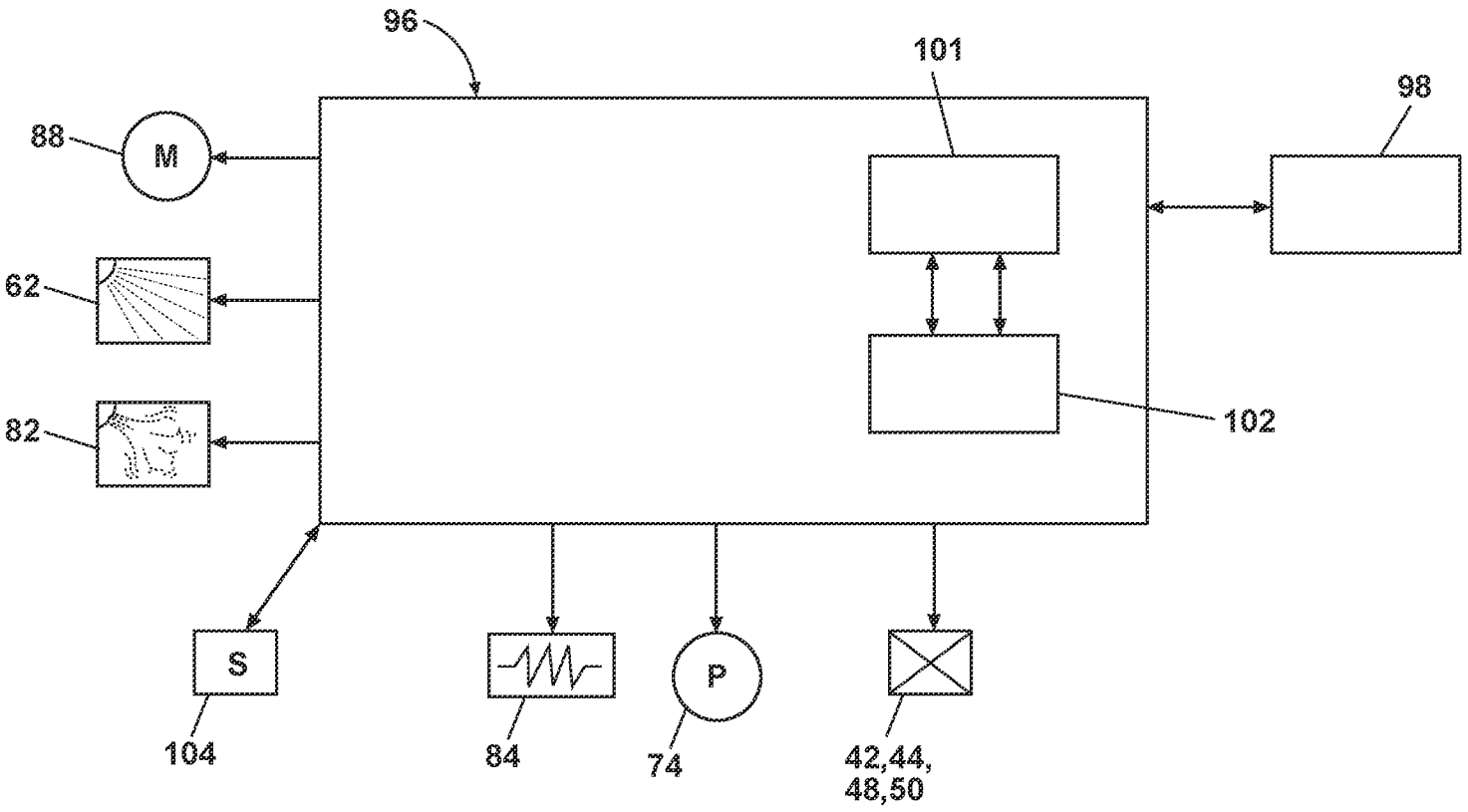
FIG. 2 is a schematic view of a controller for the washing machine of FIG. 1.

As illustrated in FIG. 2, the controller 96 can also be coupled with one or more sensors 103, 104 provided in one or more of the systems of the washing machine 10 to receive input from the sensors. Non-limiting examples of sensors 103, 104 that can be communicably coupled with the controller 96 include: a surfactant sensor, a turbidity sensor, a motor torque sensor, a pressure sensor, a conductivity sensor, a treating chamber temperature sensor, a moisture sensor, a weight sensor, a chemical sensor, a position sensor, an acceleration sensor, a speed sensor, an orientation sensor, an imbalance sensor, a load size sensor, and, which can be used to determine a variety of system and laundry characteristics, such as over-sudsing conditions.

For example, a motor torque sensor, a speed sensor, an acceleration sensor, and/or a position sensor can also be included in the washing machine 10 and can provide an output or signal indicative of the torque applied by the motor, a speed of the drum 16 or component of the drive system, an acceleration of the drum 16 or component of the drive system, and a position sensor of the drum 16. Such sensors 103, 104 can be any suitable types of sensors including, but not limited to, that one or more of the sensors 103, 104 can be a physical sensor or can be integrated with the motor and combined with the capability of the controller 96 to function as a sensor. For example, motor characteristics, such as speed, current, voltage, torque etc., can be processed such that the data provides information in the same manner as a separate physical sensor. In contemporary motors, the motors often have their own controller that outputs data for such information.

The controller 96 can be provided with a memory 101 and a central processing unit (CPU) 102. The memory 101 can be used for storing the control software that can be executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 101 can also be used to store information, such as a database or table, and to store data received from one or more components or sensors 103, 104 of the washing machine 10 that can be communicably coupled with the controller 96. The database or table can be used to store the various operating parameters for the one or more cycles of operation, including factory default values for the operating parameters and any adjustments to them by the control system or by user input. Such operating parameters and information stored in the memory 101 can include, but are not limited to, threshold values, predetermined criteria, acceleration ramps, etc.

The controller 96 can be operably coupled with one or more components of the washing machine 10 for communicating with and controlling the operation of the component to complete a cycle of operation. For example, the controller 96 can be operably coupled with the motor 88, the pump 74, the dispenser 62, the steam generator 82 and the sump heater 84 to control the operation of these and other components to implement one or more of the cycles of operation.

Figure 3:
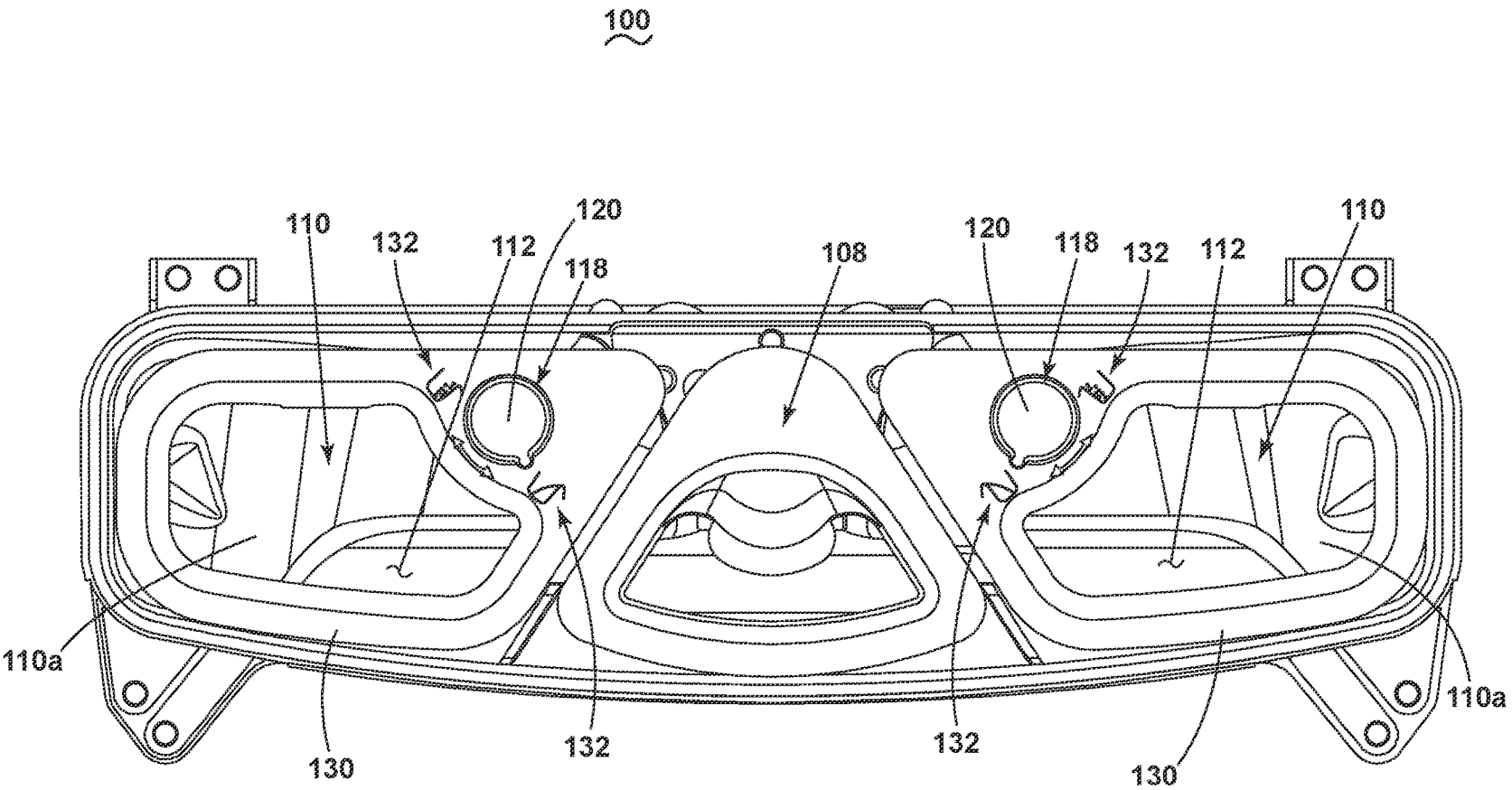
FIG. 3 is a top view of a dispenser according to an embodiment of the invention.

FIG. 3 is a top view of a dispenser 100 according to one possible specific implementation for the generic dispenser 62. The dispenser 100 can comprise one or more treating chemistry compartments 110 and 108. It is contemplated that one treating chemistry compartment 110 can be designated for a pre-wash treating chemistry while another treating chemistry compartment 110 can be designated for a main wash treating chemistry. Treating chemistry compartment 108 can be in the form of a traditional dispenser cup and can for example, be designated for an additional treating chemistry such as a stain repellent or softener.

Treating chemistry compartments 110 can comprise a chamber 112, a cover plate 130, and an actuator 118. The cover plate 130 serves as a bezel around the top of the treating chemistry compartment and is coupled to the treating chemistry compartment 110, such as its walls 110*a*, and at least partially overlies the chamber 112. Indicia 132 can be disposed on a cover plate 130 or an actuator 118 corresponding to liquid treating chemistry or powder treating chemistry settings. The actuator 118 can be coupled to the cover plate 130. While the actuator 118 is shown in the form of a rotatable knob 120, the actuator 118 can be in the form of any suitable actuator such as a toggle, handle, button, or dial. The actuator 118 provides for switching the treating chemistry compartment 110 between a powder mode, for dispensing treating chemistry in powder or granular form, and a liquid mode, for dispensing treating chemistry in a liquid form.

Figure 4A:
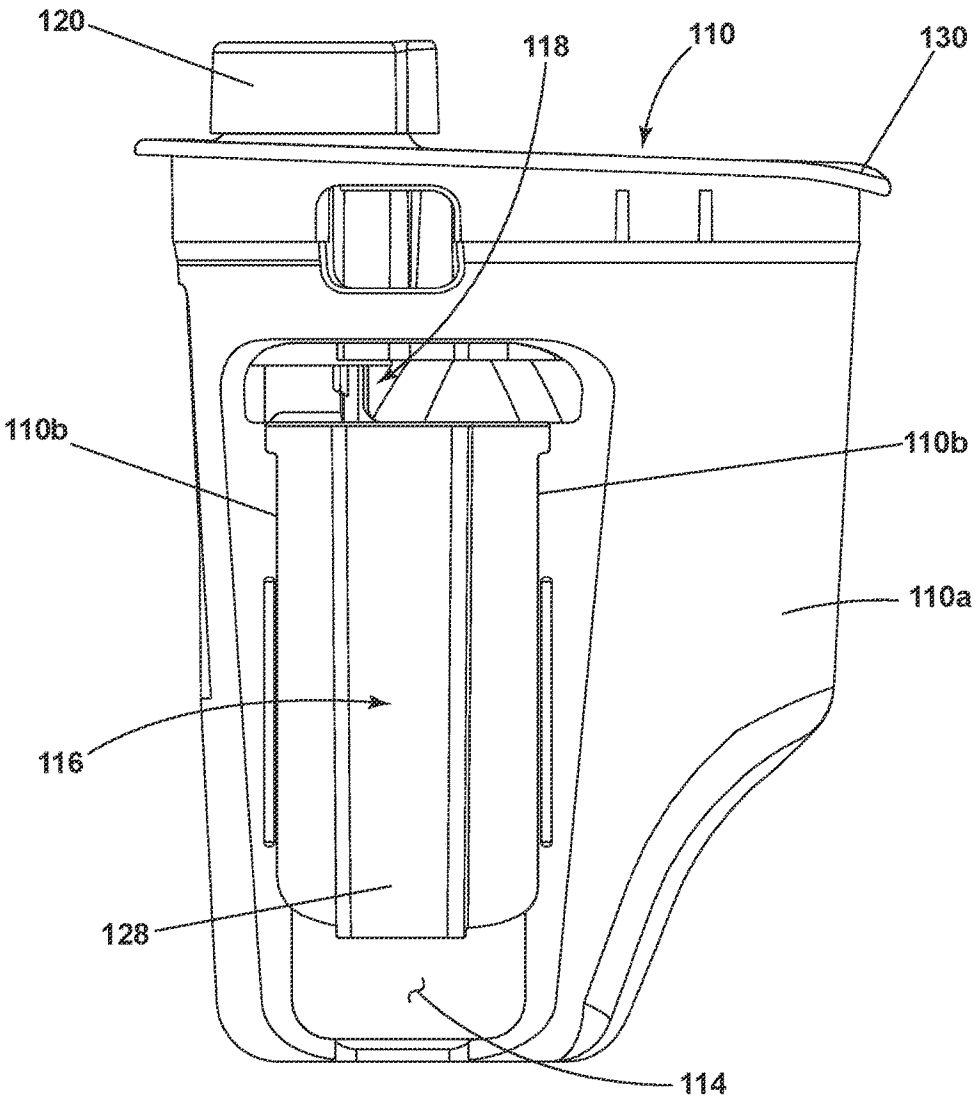
FIG. 4A is a side view of a dispensing compartment in a powder laundry treating chemistry setting according to an embodiment of the invention.
Figure 4B:
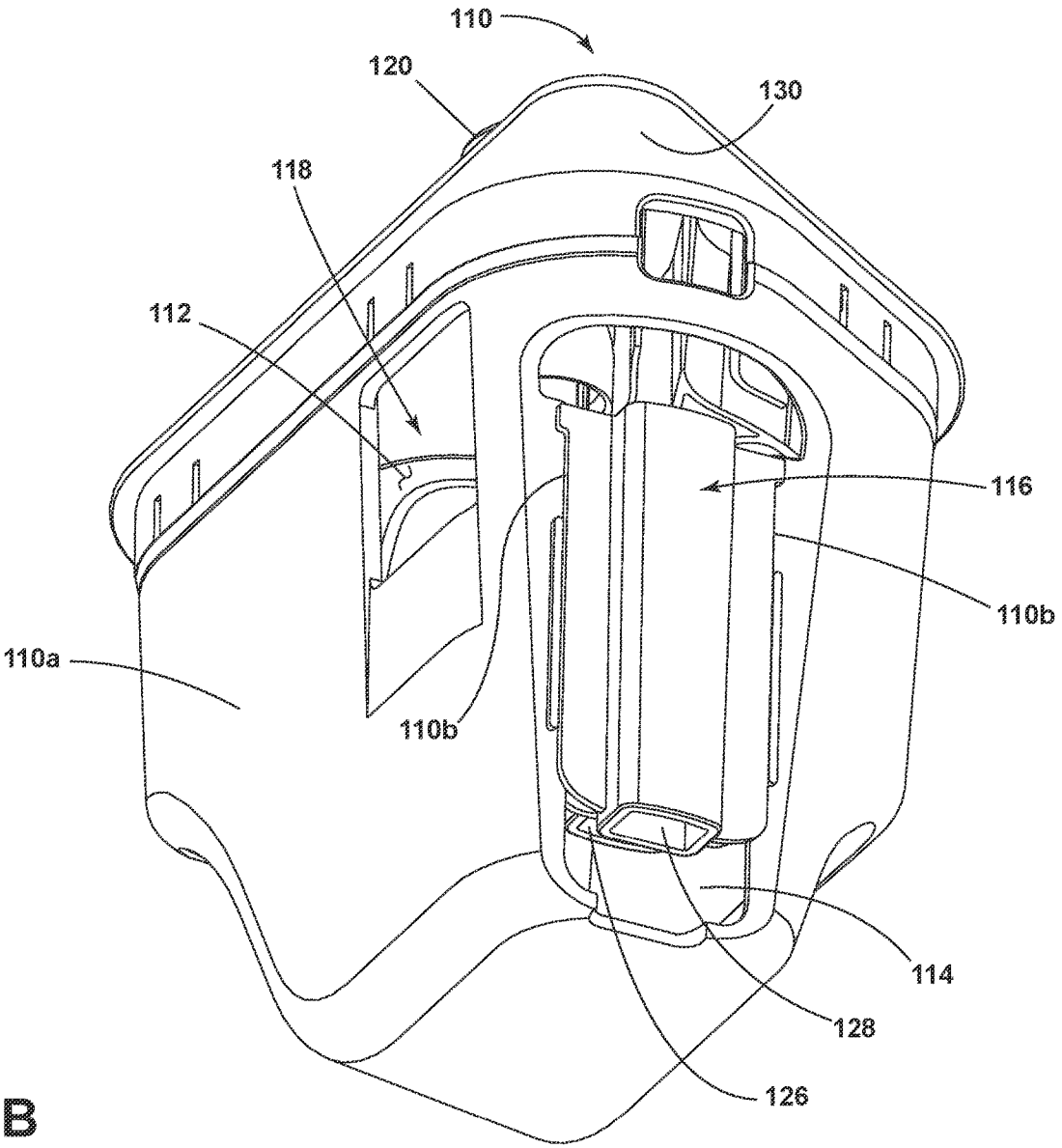
FIG. 4B is a perspective view of the dispensing compartment of FIG. 4A.

Turning to FIGS. 4A and 4B, the treating chemistry compartment 110 is illustrated in the powder mode. The chamber 112 of the treating chemistry compartment 110 comprises an outlet opening 114. The outlet opening 114 is at least partially defined by edges 110*b* of walls 110*a*. A siphon 116 is at least partially located within the chamber 112 and is movable relative to the chamber 112 between a first position, where the siphon 116 closes the outlet opening 114 to set the compartment in the liquid mode, and a second position where the siphon 116 opens at least a portion of the outlet opening 114 to set the compartment in the powder mode.

The siphon 116 comprises grooves 115 that receive the edges 110*b* to slidably mount the siphon 116 to the treating chemistry compartment 110. The grooves 115 and edges 110*b* cooperate to form a guided track along which the siphon 116 traverses. The actuator 118 moves the siphon 116 between the first position and second position, which can correlate to a liquid laundry treating chemistry setting and a powder laundry treating chemistry setting, respectively.

As best seen in FIG. 4B, the siphon 116 comprises an inlet tube 126, fluidly coupled to the chamber 112, and an outlet tube 128 fluidly coupling the inlet tube 126 to an exterior of the chamber 112. Since a portion of the outlet opening 114 is open, the siphon 116 is set in the second position in FIGS. 4A and 4B. The physical spacing of the inlet tube 126 from the bottom of the treating chemistry compartment 110 effectively "turns off" the siphon. Advantageously and simultaneously, with the siphon 116 in the second position, the outlet opening 114 is opened and provides an opening for powdered treating chemistries to be flushed out through the outlet opening 114.

Figure 5A:
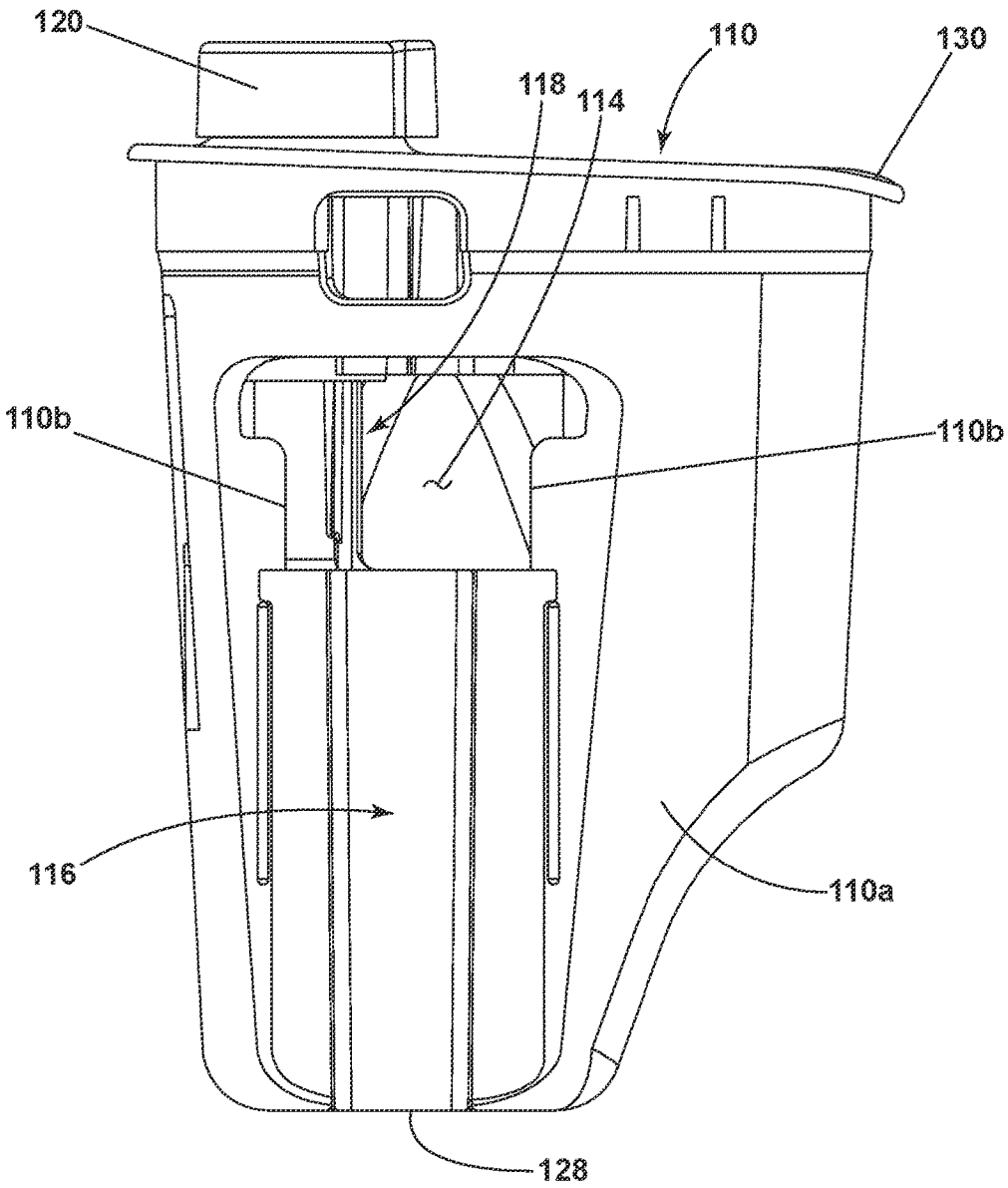
FIG. 5A is a side view of a dispensing compartment in a liquid laundry treating chemistry setting according to an embodiment of the invention.
Figure 5B:
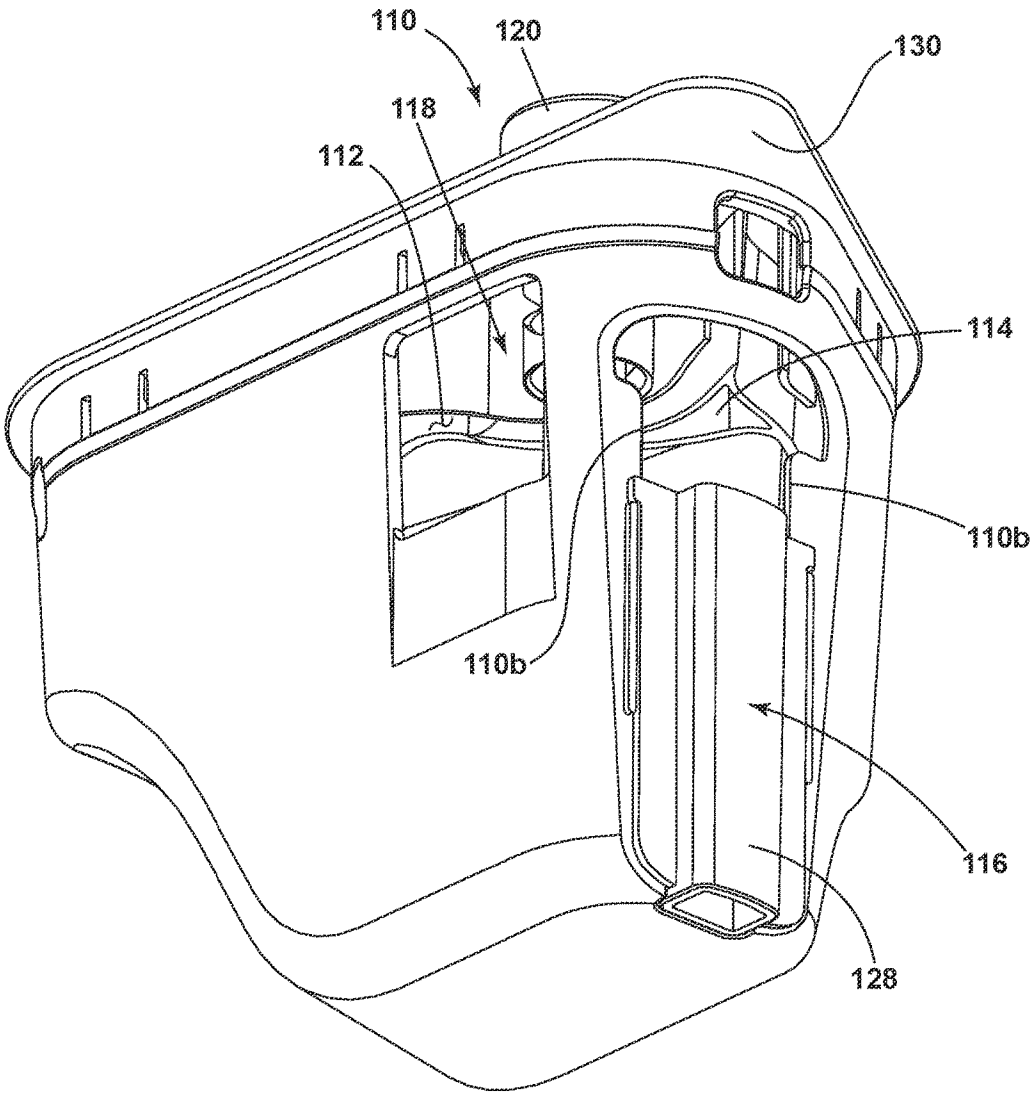
FIG. 5B is a perspective view of the dispensing compartment of FIG. 5A.

FIGS. 5A and 5B illustrate the treating chemistry compartment in a liquid mode. Since the outlet opening 114 is closed, the siphon 116 is set in the first position, which corresponds to the inlet tube 126 being spaced sufficiently close to the bottom of the treating chemistry compartment 110 to effect a siphon and draw liquid into the inlet tube 126, where it flows out through the outlet tube 128. The outlet tube 128 lies eternal of the treating chemistry compartment 110 resulting in the liquid in the treating chemistry compartment that is siphoned into the inlet tube 126 is dispensed exteriorly of the treating chemistry compartment 110.

Figure 6:
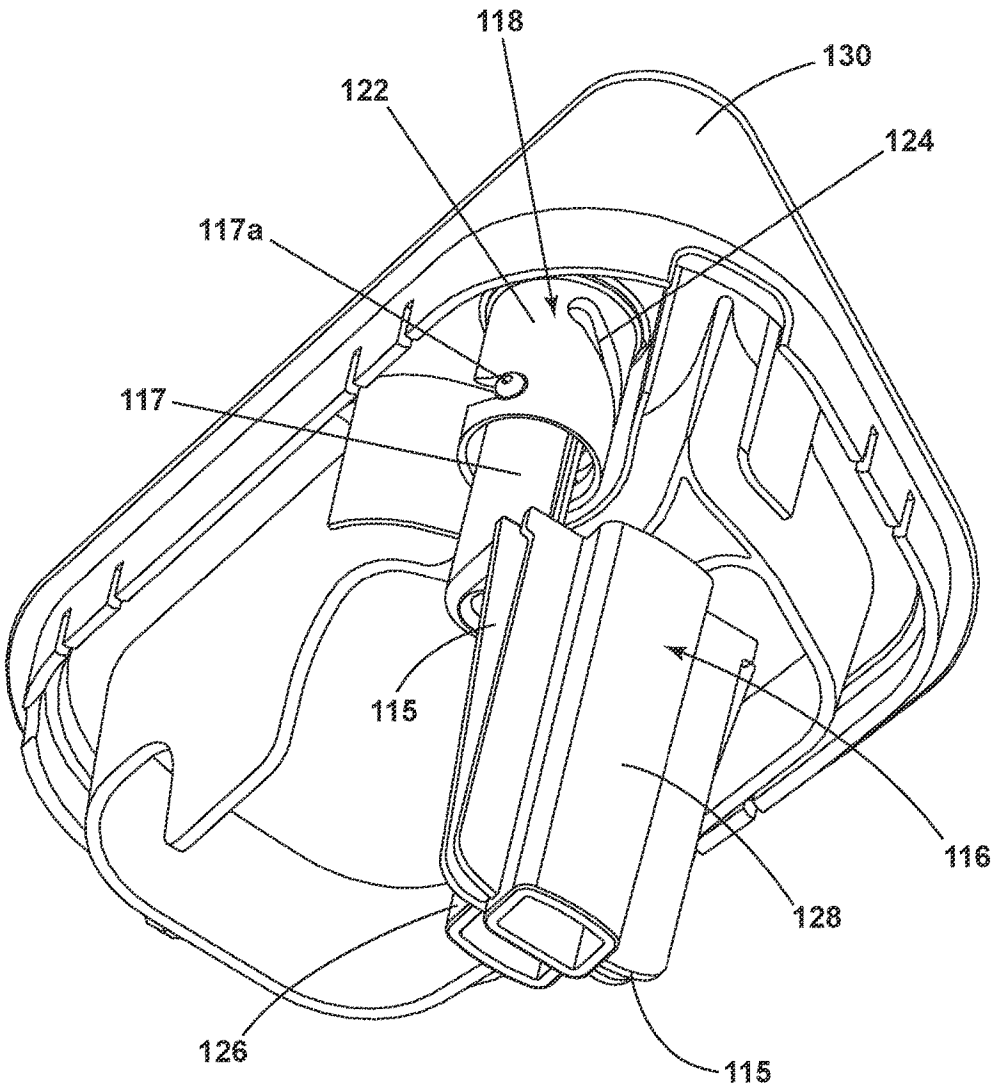
FIG. 6 is a bottom perspective view of a dispensing compartment according to an embodiment of the invention with the compartment walls removed.

FIG. 6 is a bottom, perspective view of the treating chemistry compartment with the walls 110*a* to clearly illustrate the inter-connection of the siphon 116 and the actuator 118. The siphon 116 includes a shaft 117 extending from the top of the siphon 116, with the shaft having a pin 117*a*. The actuator 118 comprises a rotatable knob 120 (FIG. 3) from which depends a sleeve 122, with a helical slot 124. The shaft 117 is reciprocally received within the sleeve 122 while the pin 117*a* is received within the helical slot 124. Therefore, when the knob 120 is rotated by a user, the pin 117*a* follows the movement of the helical slot 124 and causes the shaft 117 of the siphon 116 to move up or down, depending on the direction of rotation, in a vertical direction, thereby closing or opening the outlet opening 114 of the treating chemistry compartment 110.

To set the treating chemistry compartment in the powder mode, the knob 120 is rotated to the indicia 132 corresponding to powder, resulting in a raising of the siphon 116 into the second position, so the outlet opening 114 is at least partially open. This allows powder laundry treating chemistry that has been mixed with water to exit the chamber 112 to the exterior via the outlet opening 114 and the inlet tube 126 of the siphon 116 does not draw liquid from the chamber 112.

To set the treating chemistry compartment 110 to the liquid mode, the knob 120 is rotated to the liquid indicia thereby lowering the siphon 116 into the first position, resulting in the closing of the outlet opening 114 and the positioning of the inlet tube 126 sufficiently close to the bottom of the treating chemistry compartment 110 to effect a siphon. This allows liquid laundry treating chemistry to be drawn from the chamber 112 via the inlet tube 126 and to exit the chamber 112 to the exterior via the outlet tube 128.

To the extent not already described, the different features and structures of the various embodiments can be used in combination with each other as desired. That one feature is not illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure. Embodiments of this disclosure are not limited to top loading vertical access washing machines. Embodiments can be implemented in a washing machine having any of axis of rotation or loading type. For example, embodiments can be implemented in a top-loading vertical access washing machine, or a front-loading horizontal access washing machine.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A dispenser for a laundry treating appliance comprising:

at least one treating chemistry compartment having a chamber and defining an outlet opening fluidly coupling the chamber to an exterior of the chamber; the at least one treating chemistry compartment comprising edges;

a siphon comprising grooves that receive the edges of the at least one treating chemistry compartment to slideably connect the siphon to the at least one treating chemistry compartment for selectively opening or closing the outlet opening; and an actuator moving the siphon between a first position, wherein the siphon closes the outlet opening to enable the dispenser to operate in a liquid mode, and a second position, wherein the siphon opens at least a portion of the outlet opening to enable the dispenser to operate in a powder mode.

2. The dispenser of claim 1, wherein the outlet opening is at least partially defined by the edges of the at least one treating chemistry compartment.

3. The dispenser of claim 1 wherein the actuator comprises a rotatable knob.

4. The dispenser of claim 3 wherein the rotatable knob comprises a sleeve with a helical slot and the siphon comprises a shaft with a pin received within the helical slot.

5. The dispenser of claim 1 wherein the at least one treating chemistry compartment comprises a cover plate and the actuator is coupled to the cover plate.

6. The dispenser of claim 5 wherein the cover plate is coupled at a top of walls of the at least one treating chemistry compartment and at least partially overlies the chamber.

7. The dispenser of claim 5 wherein at least one of the cover plate or the actuator comprises indicia corresponding to the liquid and powder modes.

8. The dispenser of claim 1 wherein the siphon comprises an inlet tube, fluidly coupled to the chamber, and an outlet tube fluidly coupling the inlet tube directly to the exterior of the chamber to bypass the outlet opening when the siphon is in the first position.

9. The dispenser of claim 1 wherein the siphon is partially located within the chamber and partially outside of the chamber.

10. A laundry treating appliance comprising:

a cabinet defining an interior and having an access opening located on one of a front or top of the cabinet;

a tub located within the interior and defining a liquid reservoir;

a drum located within the liquid reservoir and rotatable about one of a horizontal or vertical axis; and a dispenser comprising at least one treating chemistry compartment having a chamber and defining an outlet opening fluidly coupling the chamber to an exterior of the chamber; the at least one treating chemistry compartment comprising edges;

a siphon comprising grooves that receive the edges of the at least one treating chemistry compartment to slideably connect the siphon to the at least one treating chemistry compartment for selectively opening or closing the outlet opening; and an actuator moving the siphon between a first position, wherein the siphon closes the outlet opening to enable the dispenser to operate in a liquid mode, and a second position, wherein the siphon opens at least a portion of the outlet opening to enable the dispenser to operate in a powder mode.

11. The laundry treating appliance of claim 10 wherein the outlet opening is at least partially defined by the edges of the at least one treating chemistry compartment.

12. The laundry treating appliance of claim 10 wherein the actuator comprises a rotatable knob.

13. The laundry treating appliance of claim 12 wherein the rotatable knob comprises a sleeve with a helical slot and the siphon comprises a shaft with a pin received within the helical slot.

14. The laundry treating appliance of claim 10 wherein the at least one treating chemistry compartment comprises a cover plate and the actuator is coupled to the cover plate.

15. The laundry treating appliance of claim 14 wherein the cover plate at least partially overlies the chamber.

16. The laundry treating appliance of claim 14 wherein at least one of the cover plate or the actuator comprises indicia corresponding to the liquid and powder modes.

17. The laundry treating appliance of claim 10 wherein the siphon comprises an inlet tube, fluidly coupled to the chamber, and an outlet tube fluidly coupling the inlet tube to the exterior of the chamber when the siphon is in the first position.

18. The laundry treating appliance of claim 10 wherein the siphon is at least partially located within the chamber; and wherein the actuator is coupled to the siphon such that rotation of the actuator causes sliding movement of the siphon.

19. A dispenser for a laundry treating appliance, the dispenser comprising:

a treating chemistry compartment having a chamber and defining an outlet opening;

a siphon connected to the treating chemistry compartment for selectively opening or closing the outlet opening; and a rotatable knob moving the siphon between a first position in which the siphon closes the outlet opening, and a second position in which the siphon opens at least a portion of the outlet opening.

20. A laundry treating appliance comprising:

a cabinet defining an interior and having an access opening located on one of a front or top of the cabinet;

a tub located within the interior and defining a liquid reservoir;

a rotatable drum located within the liquid reservoir; and the dispenser of claim 19;

wherein the dispenser is configured to dispense a treating chemistry to the tub.

* * * * *